US006245732B1

(12) United States Patent
Gallon et al.

(10) Patent No.: US 6,245,732 B1
(45) **Date of Patent: *Jun. 12, 2001**

(54) DELIVERY SYSTEM HAVING RELEASE INHIBITOR LOADED ZEOLITE AND METHOD FOR MAKING SAME

(75) Inventors: Lois Sara Gallon, Finneytown; Janet Sue Littig, Fairfield, both of OH (US)

(73) Assignee: The Procter Gamble Co., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/155,139

(22) PCT Filed: Mar. 5, 1997

(86) PCT No.: PCT/US97/03283

§ 371 Date: Sep. 22, 1998

§ 102(e) Date: Sep. 22, 1998

(87) PCT Pub. No.: WO97/34981

PCT Pub. Date: Sep. 25, 1997

Related U.S. Application Data

(60) Provisional application No. 60/013,948, filed on Mar. 22, 1996.

(51) Int. Cl.[7] ..... C11D 3/08

(52) U.S. Cl. ..... 510/507; 510/101; 510/349; 510/438; 510/441; 510/444; 510/446

(58) Field of Search ..... 510/101, 438, 510/441, 444, 446, 507

(56) References Cited

U.S. PATENT DOCUMENTS

| | | | | |
|---|---|---|---|---|
| 3,576,760 | | 4/1971 | Gould et al. | 252/403 |
| 4,096,072 | | 6/1978 | Brock et al. | 252/8.8 |
| 4,152,272 | | 5/1979 | Young | 252/8.8 |
| 4,209,417 | | 6/1980 | Whyte | 252/174.11 |
| 4,304,675 | | 12/1981 | Corey et al. | 252/8.6 |
| 4,339,356 | | 7/1982 | Whyte | 252/522 |
| 4,402,856 | | 9/1983 | Schnoring et al. | 428/402.22 |
| 4,440,663 | * | 4/1984 | Boyer et al. | 252/174.11 |
| 4,539,135 | | 9/1985 | Ramachandran et al. | 252/174.11 |
| 4,713,193 | | 12/1987 | Tai | 252/91 |
| 4,806,363 | | 2/1989 | Mookherjee et al. | 426/3 |
| 4,973,422 | * | 11/1990 | Schmidt | 252/174.11 |
| 5,008,437 | | 4/1991 | Mookherjee et al. | 560/35 |
| 5,066,419 | | 11/1991 | Walley et al. | 252/174.11 |
| 5,094,761 | | 3/1992 | Trinh et al. | 252/8.9 |
| 5,137,646 | * | 8/1992 | Schmidt et al. | 252/8.8 |
| 5,288,423 | * | 2/1994 | Behan et al. | 252/174.11 |
| 5,336,665 | | 8/1994 | Garner-Gray et al. | 512/4 |
| 5,648,328 | * | 7/1997 | Angell et al. | 510/441 |
| 5,656,584 | * | 8/1997 | Angell et al. | 510/441 |
| 5,691,303 | * | 11/1997 | Pan et al. | 512/4 |
| 5,804,538 | * | 9/1998 | Wei et al. | 510/101 |
| 5,843,875 | * | 12/1998 | Wei et al. | 510/101 |
| 5,858,959 | * | 1/1999 | Surutzidis et al. | 510/507 |
| 5,955,419 | * | 9/1999 | Barket, Jr. et al. | 510/507 |

FOREIGN PATENT DOCUMENTS

| | | | |
|---|---|---|---|
| 0 149 264 | 7/1985 | (EP) | C11D/3/12 |
| 0 535 942 | 4/1993 | (EP) | C11D/3/00 |
| 0 536 942 | 4/1993 | (EP) | A61K/7/46 |
| 01 256 597 | 10/1989 | (JP) . | |
| 4 218 583 | 10/1992 | (JP) | C09K/3/100 |
| WO 94/28107 | 12/1994 | (WO) | C11D/3/50 |
| WO 97/11152 | 3/1997 | (WO) | C11D/17/00 |

* cited by examiner

*Primary Examiner*—Necholus Ogden
(74) *Attorney, Agent, or Firm*—Richard S. Echler, Sr.; Kim W. Zerby; Steven W. Miller

(57) ABSTRACT

A laundry agent delivery particle and granular compositions including the particle are provided. The particle comprises a porous carrier selected from the group consisting of Zeolite X, Zeolite Y and mixtures thereof with the porous carrier including a number of pore openings. The laundry release inhibitor is then incorporated into the porous carrier so that the cross-sectional area of the release inhibitor is larger than the cross-sectional area of the pore openings of the porous carrier. The laundry release inhibitor includes the residue of a deliverable agent such as a perfume component. The deliverable agent is then entrapped in the porous carrier until the release inhibitor is hydrolyzed thereby releasing the deliverable agent and allowing it to escape from the porous carrier.

4 Claims, No Drawings

DELIVERY SYSTEM HAVING RELEASE INHIBITOR LOADED ZEOLITE AND METHOD FOR MAKING SAME

This appln is a 371 of PCT/US97/03283 filed Mar. 5, 1997 which claims benefit of provisional no. 60/013,948 filed Mar. 22, 1996.

FIELD OF THE INVENTION

The present invention relates to delivery particles, particularly to laundry particles for the delivery of agents such as perfume agents, methods for making the particles and detergent compositions including the laundry particles, especially granular detergents.

BACKGROUND OF THE INVENTION

Most consumers have come to expect scented laundry products and to expect that fabrics which have been laundered also have a pleasing fragrance. Perfume additives make laundry compositions more aesthetically pleasing to the consumer, and in some cases the perfume imparts a pleasant fragrance to fabrics treated therewith. However, the amount of perfume carryover from an aqueous laundry bath onto fabrics is often marginal. Industry, therefore, has long searched for an effective perfume delivery system for use in laundry products which provides long-lasting, storage-stable fragrance to the product, as well as fragrance to the laundered fabrics.

Laundry and other fabric care compositions which contain perfume mixed with or sprayed onto the compositions are well known from commercial practice. Because perfumes are made of a combination of volatile compounds, perfume can be continuously emitted from simple solutions and dry mixes to which the perfume has been added. Various techniques have been developed to hinder or delay the release of perfume from compositions so that they will remain aesthetically pleasing for a longer length of time. To date, however, few of the methods deliver significant fabric odor benefits after prolonged storage of the product.

Moreover, there has been a continuing search for methods and compositions which will effectively and efficiently deliver perfume from a laundry bath onto fabric surfaces. As can be seen from the following disclosures, various methods of perfume delivery have been developed involving protection of the perfume 35 through the wash cycle, with release of the perfume onto fabrics. U.S. Pat. No. 4,096,072, Brock et al, issued Jun. 20, 1978, teaches a method for delivering fabric conditioning agents, including perfume, through the wash and dry cycle via a fatty quatemary ammonium salt. U.S. Pat. No. 4,402,856, Schnoring et al, issued Sep. 6, 1983, teaches a microencapsulation technique which involves the formulation of a shell material which will allow for diffusion of perfume out of the capsule only at certain temperatures. U.S. Pat. No. 4,152,272, Young, issued May 1, 1979, teaches incorporating perfume into waxy particles to protect the perfume through storage in dry compositions and through the laundry process. The perfume assertedly diffuses through the wax on the fabric in the dryer. U.S. Pat. No. 5,066,419, Walley et al, issued Nov. 19, 1991, teaches perfume dispersed with a water-insoluble nonpolymeric carrier material and encapsulated in a protective shell by coating with a water-insoluble friable coating material. U.S. Pat. No. 5,094,761, Trinh et al, issued Mar. 10, 1992, teaches a perfume/cyclodextrin complex protected by clay which provides perfume benefits to at least partially wetted fabrics.

Another method for delivery of perfume in the wash cycle involves combining the perfume with an emulsifier and water-soluble polymer, forming the mixture into particles, and adding them to a laundry composition, as is described in U.S. Pat. No. 4,209,417, Whyte, issued Jun. 24, 1980; U.S. Pat. No. 4,339,356, Whyte, issued Jul. 13, 1982; and U.S. Pat. No. 3,576,760, Gould et al, issued Apr. 27, 1971. However, even with the substantial work done by industry in this area, a need still exists for a simple, more efficient and effective perfume delivery system which can be mixed with laundry compositions to provide initial and lasting perfume benefits to fabrics which have been treated with the laundry product.

The perfume can also be adsorbed onto a porous carrier material, such as a polymeric material, as described in U.K. Pat. Pub. 2,066,839, Bares et al, published Jul. 15, 1981. Perfumes have also been adsorbed onto a clay or zeolite material which is then admixed into particulate detergent compositions. Generally, the preferred zeolites have been Type A or 4A Zeolites with a nominal pore size of approximately 4 Angstrom units. It is now believed that with Zeolite A or 4A, the perfume is adsorbed onto the zeolite surface with relatively little of the perfume actually absorbing into the zeolite pores. While the adsorption of perfume onto zeolite or polymeric carriers may perhaps provide some improvement over the addition of neat perfume admixed with detergent compositions, industry is still searching for improvements in the length of storage time of the laundry compositions without loss of perfume characteristics, in the intensity or amount of fragrance delivered to fabrics, and in the duration of the perfume scent on the treated fabric surfaces.

Combinations of perfumes generally with larger pore size zeolites X and Y are also taught in the art. East German Patent Publication No. 248,508, published Aug. 12, 1987 relates to perfume dispensers (e.g., an air freshener) containing a faujasite-type zeolite (e.g., zeolite X and Y) loaded with perfumes. The critical molecular diameters of the perfume molecules are said to be between 2–8 Angstroms. Also, East German Patent Publication No. 137,599, published Sep. 12, 1979 teaches compositions for use in powdered washing agents to provide thennoregulated release of perfume. Zeolites A, X and Y are taught for use in these compositions. These earlier teachings are repeated in the more recently filed European applications Publication No. 535,942, published Apr. 7, 1993, and Publication No. 536, 942, published Apr. 14, 1993, by Unilever PLC, and U.S. Pat. No. 5,336,665, issued Aug. 9, 1994 to Garner-Gray et al.

Effective perfume delivery compositions are taught by WO 94/28107, published Dec. 8, 1994 by The Procter & Gamble Company. These compositions comprise zeolites having pore size of at least 6 Angstroms (e.g., Zeolite X or Y), perfume releaseably incorporated in the pores of the zeolite, and a matrix coated on the perfumed zeolite comprising a water-soluble (wash removable) composition in which the perfume is substantially insoluble, comprising from 0% to about 80%, by weight, of at least one solid polyol containing more than 3 hydroxyl moieties and from about 20% to about 100%, by weight, of a fluid diol or polyol in which the perfume is substantially insoluble and in which the solid polyol is substantially soluble.

Another problem in providing perfiumed products is the odor intensity associated with the products. A need therefore exists for a perfume delivery system which provides satisfactory perfume odor during use and thereafter from the dry fabric, but which also provides prolonged storage benefits and reduced product odor intensity.

BACKGROUND ART

U.S. Pat. No. 4,539,135, Ramachandran et al, issued Sep. 3, 1985, discloses particulate laundry compounds comprising a clay or zeolite material carrying perfume. U.S. Pat. No. 4,713,193, Tai, issued Dec. 15, 1987, discloses a free-flowing particulate detergent additive comprising a liquid or oily adjunct with a zeolite material. Japanese Patent HEI 4[1992]-218583, Nishishiro, published Aug. 10, 1992, discloses controlled-release materials including perfumes plus zeolites. U.S. Pat. No. 4,304,675, Corey et al, issued Dec. 8, 1981, teaches a method and composition comprising zeolites for deodorizing articles. East German Patent Publication No. 248,508. published Aug. 12, 1987, East German Patent Publication No. 137,599, published Sep. 12, 1979; European applications Publication No. 535,942, published Apr. 7, 1993, and Publication No. 536,942, published Apr. 14. 1993, by Unilever PLC, U.S. Pat. No. 5,336,665, issued Aug. 9, 1994 to Gamer-Gray et al.; and WO 94/28107, published Dec. 8, 1994, also disclose zeolite materials. U.S. Pat. No. 4,806,363 discloses flavoring with Schiff Base reaction products of alkyl anthranilates. U.S. Pat. No. 5,008,437 discloses Schiff Base reaction products of ethyl vanillin and methyl anthranilate and organoleptic uses for the reaction product. Schiff Base complexes with metals are disclosed in "Zeolite Encapsulated Metal-Schiff Base Complexes. Synthesis and Electrochemical Characterization.", Bedioui et al, Zeolites and Related Microporous Materials:State of the Art 1994 Studies in Surface Science and Catalysis, Vol. 84, J. Weitkamp et al eds., pp 917–924. Perfume Schiff Base complexes are disclosed in "Chemical Release Control-Schiff Bases of Perfume Aldehydes and Aminostyrenes" Journal of Polymer Science: Polymer Chemistry Edition, Vol. 20, 3121–3129 (1982).

SUMMARY OF THE INVENTION

This need is met by the present invention wherein a perfume delivery system having a laundry release inhibitor loaded zeolite is provided. The laundry release inhibitor includes a deliverable agent residue and a size enlarging agent residue. The laundry release inhibitor has a cross-sectional area which is larger than the cross-sectional area of the pores of the zeolite carrier. Thus, the laundry release inhibitor cannot be released from the zeolite. The deliverable agent is then entrapped in the zeolite until the release inhibitor has hydrolyzed thereby freeing the deliverable agent and allowing escape from the zeolite. The laundry release inhibitor is formed in-situ in the zeolite from the deliverable agent and the size enlarging agent.

The present invention solves the long-standing need for a simple, effective, storage-stable delivery system which provides benefits (especially fabric odor benefits) during and after the laundering process. Further, perfume-containing compositions employing the particles of the present invention have reduced product odor during storage of the composition.

According to a first embodiment of the present invention, a laundry agent delivery particle is provided. The particle comprises:

a) a porous carrier selected from the group consisting of Zeolite X. Zeolite Y and mixtures thereof. with the porous carrier including a number of pore openings; and b) a laundry release inhibitor incorporated into the porous carrier wherein the cross sectional area of the release inhibitor is larger than the cross sectional area of the pore openings of the porous carrier. The release inhibitor includes the residue of at least one deliverable agent which can be released from the porous carrier upon hydrolysis of the release inhibitor.

Preferably, the deliverable agent is a perfume agent. The perfume agent should include at least one functional group selected from the group consisting of aldehyde, ketone, amine, alcohol, ester or mixtures thereof. The perfume agent should have a boiling point less than 300° C. and a ClogP value greater than about 1.0. The laundry release inhibitor is formed in-situ in the porous carrier from the deliverable agent and a size enlarging agent. Preferably, both the deliverable agent and the size enlarging agent are perfume materials. Also, the laundry particle may further include a coating matrix on the porous carrier.

According to another embodiment of the present invention, a granular detergent composition is provided. The granular detergent composition comprises:

a) from about 0.001% to about 50% by weight of the composition of a laundry particle comprising:
   i) a porous carrier selected from the group consisting of Zeolite X, Zeolite Y and mixtures thereof with the porous carrier including a number of pore openings;
   ii) a laundry release inhibitor incorporated into the porous carrier wherein the cross sectional area of the release inhibitor is larger than the cross sectional area of the pore openings of the porous carrier; and b) from about 40% to about 99.99% by weight of the composition of laundry ingredients selected from the group consisting of detersive surfactants, builders, bleaching agents, enzymes, soil release polymers, dye transfer inhibitors, and mixtures thereof.

According to yet another embodiment of the present invention, a process for producing a laundry particle is provided. The process comprises the steps of:

a) providing a porous carrier selected from the group consisting of Zeolite X, Zeolite Y and mixtures thereof with the porous carrier including a number of pore openings;

b) providing at least one deliverable agent having at least one functional group selected from the group consisting of an aldehyde, a ketone, an amine, an alcohol, an ester or mixtures thereof;

c) providing a size enlarging agent;

d) loading the deliverable agent and the size enlarging agent into the porous carrier; and e) forming a loaded carrier particle from the deliverable agent and the size enlarging agent to form a release inhibitor within the porous carrier wherein the cross sectional area of the release inhibitor is larger than the cross sectional area of the pore openings of the porous carrier.

Preferably, the deliverable agent is a perfume material. Lastly, the process may further comprise the step of coating the loaded carrier particle with a coating matrix. The step of forming the loaded particle may further comprise the step of heating the loaded carrier to a temperature of from about 5° C. to about 200° C. and the step of loading the the deliverable agent and the size enlarging agent further comprises the step of loading the deliverable agent and the size enlarging agent independently without mixing prior to entry into the zeolite.

Accordingly, it is an object of the present invention to provide a laundry particle having a laundry release inhibitor incorporated into a zeolite carrier. It is another object of the present invention to provide a granular detergent composition having a laundry particle with a laundry release inhibitor incorporated into a zeolite carrier. It is yet another object of the present invention to provide a process for making a laundry particle with a laundry release inhibitor incorporated into a zeolite carrier. Lastly, it an object of the present invention to provide a laundry particle which can provide improved fabric odor benefits, prolonged storage life capabilities, and reduced product odor intensity. These and other objects, features and advantages of the present invention will be recognizable to one of ordinary skill in the art from the following description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

The present invention relates to a laundry agent delivery system comprising a porous carrier which is a Type X zeolite, Type Y zeolite or mixtures thereof, wherein a laundry release inhibitor has been formed in the pores of the zeolite. The laundry release inhibitor is formed in-situ in the pores of the zeolite. It has a cross-sectional area which is larger than the cross-sectional area of the of the pore openings of the zeolite. Thus, the release inhibitor cannot escape or diffuse from the zeolite.

The release inhibitor is formed from the deliverable agent, such as a perfume and a size enlarging agent. Both the deliverable agent and the size enlarging agent are compounds or mixtures of compounds which are themselves small enough to be incorporated into the pore openings of the zeolite. In this manner, a deliverable agent such as a perfume is trapped within the zeolite. The deliverable agent cannot then escape from the zeolite until the release inhibitor has been hydrolyzed thereby releasing the deliverable agent and the size enlarging agent. In addition, when mixtures of perfume materials are employed, only one or a few of the materials in the mixture need act in conjunction with the size enlarging agent to form the release inhibitor. However, the release inhibitor will act to block all components loaded into the zeolite including those perfume ingredients which have not reacted.

By employing a particle including a release inhibitor, materials such as perfume raw materials can be easily and efficiently incorporated into products. In particular, perfume materials for laundry compositions can be effectively delivered through the wash to the fabric surface. The use of a laundry particle of the present invention reduces the amount of perfume which is lost in the wash (which is typically greater than 70% in prior art products) and delivers a larger volume of perfume to the fabric surface. In addition, as the volatile perfume material is entrapped within the zeolite, the amount of perfune which escapes and volatilizes from a product into which it is incorporated is reduced through the use of the particle of the present invention. Thus, prolonged storage times are increased and importantly product odor is minimized without greatly impacting the amount of perfume delivered to the fabric surface.

Deliverable Agent

The deliverable agents according to the present invention may be selected from laundry agents such as perfumes, insect repellents, antimicrobial compounds, bleach activators, etc. or a mixture of agents. In particular, the deliverable agent of the present invention is perfume material or a mixture of perfume materials. Of course, both the deliverable agent and the size enlarging agent must be capable of incorporation into the pores of the zeolite material. These deliverable agents are selected for use in the present invention based on specific selection criteria as described in detail hereinafter. Such selection criteria allow the formulator to take advantage of the interactions between agents to maximize consumer noticeable benefits while minimizing the quantities of agents utilized.

This is not to say that the mixture of laundrv agents cannot comprise some amount of laundry agents which are incapable of being incorporated into the pores of the zeolite. Such laundry agents may be and typically are present, but only to the extent that they do not substantially interfere with the incorporation of the laundry agents selected for incorporation into the zeolite pores. Such materials may be included in the mixture of laundry agents that comprises deliverable agents (as defined hereinafter) to be incorporated into the zeolite, but preferably are part of the laundry components added separately to the laundry composition. For example, preferred herein are laundry compositions which further contain perfume agents added to (typically by spraying on) the final laundry composition containing laundry particles according to the present invention. Such additional perfume agents may be the same as the perfume agents incorporated into the zeolite, but preferably are a different but complementary perfume mixture.

The selection criteria are defined hereinafter which identify raw materials and combinations that are useful as deliverable agents according to the present invention.

While little is known in the literature about the exact location of guest molecules in zeolite, a good body of work has developed around the diffusion of materials into zeolite's structured pores (J. Karger, D. M. Ruthven, "Diffusion in Zeolites", John Willey & Sons, New York, 1992). The primary factor that influences inclusion of a guest molecule into a zeolite pore is the size of the guest molecule relative to the zeolite pore opening. While zeolite pores have been well characterized, perfume molecules are not traditionally defined by their size parameters; such are typically ignored by the prior art systems which sought to use zeolites are carriers, with the exception being the general size description relating to air freshener compositions contained in East German Patent Publication No. 248,508, published Aug. 12, 1987.

However, for purposes of the present invention compositions exposed to the aqueous medium of the laundry wash process, several characteristic parameters of guest molecules are important to identify and define: their longest and widest measures; cross sectional area; molecular volume; and molecular surface area. These values are calculated for individual agents (e.g., individual perfume molecules) using the CHEMX program (from Chemical Design, Ltd.) for molecules in a minimum energy conformation as determined by the standard geometry optimized in CHEMX and using standard atomic van der Waal radii. Definitions of the parameters are as follows:

"Longest": the greatest distance (in Angstroms) between atoms in the molecule augmented by their van der Waal radii.

"Widest": the greatest distance (in Angstroms) between atoms in the molecule augmented by their van der Waal radii in the projection of the molecule on a plane perpendicular to the "longest" axis of the molecule.

"Cross Sectional Area": area (in square Angstrom units) filled by the projection of the molecule in the plane perpendicular to the longest axis.

"Molecular Volume": the volume (in cubic Angstrom units) filled by the molecule in its minimum energy configuration.

"Molecular Surface Area": arbitrary units that scale as square Angstroms (for calibration purposes, the molecules methyl beta naphthyl ketone, benzyl salicylate, and camphor gum have surface areas measuring 128±3, 163.5±3, and 122.5±3 units respectively).

The shape of the molecule is also important for incorporation. For example, a synunetric perfectly spherical molecule that is small enough to be included into the zeolite channels has no preferred orientation and is incorporated from any approach direction. However, for molecules that have a length that exceeds the pore dimension, there is a preferred "approach orientation" for inclusion. Calculation of a molecule's volume/surface area ratio is used herein to express the "shape index" for a molecule. The higher the value, the more spherical the molecule.

For purposes of the present invention, agents are classified according to their ability to be incorporated into zeolite pores, and hence their utility as components for delivery from the zeolite carrier through an aqueous environment. Plotting these agents in a volume/surface area ratio vs. cross sectional area plane (see FIG. 1) permits convenient classification of the agents in groups according to their incorporability into zeolite. In particular, for the zeolite X and Y carriers according to the present invention, agents are incorporated if they fall below the line (herein referred to as the "incorporation line") defined by the equation:

$$y=-0.01068x+1.497$$

where x is cross sectional area and y is volume/surface area ratio. Agents that fall below the incorporation line are referred to herein as "deliverable agents"; those agents that fall above the line are referred to herein as "non-deliverable agents".

For containment through the wash in addition to that provided by the release inhibitor, deliverable agents may be retained in the zeolite carrier as a function of their affinity for the carrier relative to competing deliverable agents. Affinity may be impacted by the molecule's size hydrophobicity, functionality, volatility, etc., and can be effected via interaction between deliverable agents within the zeolite carrier. These interactions permit improved through the wash containment for the deliverable agents mixture incorporated. Specifically, for the present invention, the use of deliverable agents having at least one dimension that is closely matched to the zeolite carrier pore dimension may contributes to the slowing of the loss of other deliverable agents in the aqueous wash environment. Deliverable agents that function in this manner are referred to herein as "blocker agents", and are defined herein in the volume/surface area ratio vs. cross sectional area plane as those deliverable agent molecules failing below the "incorporation line" (as defined hereinbefore) but above the line (herein referred to as the "blocker line") defined by the equation:

$$y=-0.01325x+1.46$$

where x is cross sectional area and y is volume/surface area ratio.

For the present invention compositions which utilize zeolite X and Y as the carriers, all deliverable agents below the "incorporation line" can be delivered and released from the present invention compositions, with the preferred materials being those falling below the "blocker line". Laundry agents mixtures useful for the present invention laundry particles preferably comprise from about 5% to about 100% (preferably from about 25% to about 100%; more preferably from about 50% to about 100%) deliverable agents (except that said laundry agents do not comprise more than 6% of a mixture of non-deliverable agents containing at least 0.1% isobutyl quinoline, at least 1.5% galaxolide 50%, at least 0.5% musk xylol, at least 1.0% exaltex, and at least 2.5% patchouli oil). When blocker agents are employed, they generally comprise from about 0.1% to about 100% (preferably from about 0.1% to about 50%) blocker agents, by weight of the laundry agents mixture.

Obviously for the present invention compositions whereby perfume agents are being delivered by the compositions, sensory perception is required for a benefit to be seen by the consumer. For the present invention, the most preferred perfume agents useful herein have a threshold of noticability (measured as odor detection thresholds ("ODT") under carefully controlled GC conditions as described in detail hereinafter) less than or equal to 10 parts per billion ("ppb"). Agents with ODTs between 10 ppb and 1 part per million ("ppm") are less preferred. Agents with ODTs above 1 ppm are preferably avoided. Laundry agent perfume mixtures useful for the present invention laundry particles preferably comprise from about 0% to about 80% of deliverable agents with ODTs between 10 ppb and 1 ppm, and from about 20% to about 100% (preferably from about 30% to about 100%; more preferably from about 50% to about 100%) of deliverable agents with ODTs less than or equal to 10 ppb.

Also preferred are perfumes carried through the laundry process and thereafter released into the air around the dried fabrics (e.g., such as the space around the fabric during storage). This requires movement of the perfume out of the zeolite pores with subsequent partitioning into the air around the fabric. Preferred perfume agents are therefore further identified on the basis of their volatility. Boiling point is used herein as a measure of volatility and preferred materials have a boiling point less than 300° C. Laundry agent perfume mixtures useful for the present invention laundry particles preferably comprise at least about 50% of deliverable agents with boiling point less than 300° C. (preferably at least about 60%; more preferably at least about 70%).

In addition, preferred laundry particles herein comprise compositions wherein at least about 80%, and more preferably at least about 90%, of the deliverable agents have a "ClogP value" greater than about 1.0. ClogP values are obtained as follows.

Calculation of ClogP

These perfume ingredients are characterized by their octanol/water partition coefficient P. The octanol/water partition coefficient of a perfume ingredient is the ratio between its equilibrium concentration in octanol and in water. Since the partition coefficients of most perfume ingredients are large, they are more conveniently given in the form of their logarithm to the base 10, logP.

The logP of many perfume ingredients has been reported; for example, the Pomona92 database, available from Daylight Chemical Information Systems, Inc. (Daylight CIS), contains many, along with citations to the original literature.

However, the logP values are most conveniently calculated by the "CLOGP" program, also available from Daylight CIS. This program also lists experimental logp values when they are available in the Pomona92 database. The "calculated logp" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each perfume ingredient and takes into account the numbers and types of atoms, the atom connectivity, and chemical bonding. The ClogP values, which are the most reliable and widely used estimates for this physicochemical property, can be used instead of the experimental logP values in the selection of perfume ingredients.

Determination of Odor Detection Thresholds

The gas chromatograph is characterized to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 0.2 minutes, the sampled volume is calculated. Since the precise concentration at the detector at any point in time is known, the mass per volume inhaled is known and hence the concentration of material. To determine whether a material has a threshold below 10 ppb, solutions are delivered to the sniff port at the back-calculated concentration. A panelist sniffs the GC effluent and identifies the retention time when odor is noticed. The average over all panelists determines the threshold of noticeability.

The necessary amount of analyte is injected onto the column to achieve a 10 ppb concentration at the detector. Typical gas chromatograph parameters for determining odor detection thresholds are listed below.

GC: 5890 Series II with FID detector

7673 Autosampler Column: J & W Scientific DB-1

Length 30 meters ID 0.25 mm film thickness 1 micron

Method:

Split Injection: 17/1 split ratio

Autosampler: 1.13 microliters per injection

Column Flow: 1.10 mL/minute

Air Flow: 345 mL/minute

Inlet Temp. 245° C.

Detector Temp. 285° C.

Temperature Information

Initial Temperature: 50° C.

Rate: 5C/minute

Final Temperature: 280° C.

Final Time: 6 minutes

Leading assumptions: 0.02 minutes per sniff

GC air adds to sample dilution

The component materials are described below.

A wide variety of compounds are known for perfume uses, including materials having at least one reactive functional group selected from aldehydes, ketones, arnines, alcohols, acetals, ketals, mercaptans, phenols, esters and mixtures thereof. Thus, perfume agents according to the present invention may include more than one reactive functional group. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor within the selection criteria defined hereinbefore.

Typical perfume agents which are deliverable agents useful for the present invention compositions, alone or in any combination as desired for the odor impression being sought, include but are not limited to the following.

| Agents | ODT ≦ 10 ppb | BP < 300° C. | ClogP > 1.0 |
|---|---|---|---|
| ethyl aceto acetate | No | — | No |
| cis-3-hexenyl acetate | No | — | Yes |

-continued

| Agents | ODT ≦ 10 ppb | BP < 300° C. | ClogP > 1.0 |
|---|---|---|---|
| amyl acetate | — | Yes | Yes |
| hexyl formate | — | — | Yes |
| beta gamma hexenol | No | — | Yes |
| prenyl acetate | No | — | — |
| dipropylene glycol | — | Yes | No |
| ethyl amyl ketone | No | Yes | Yes |
| methyl hexyl ketone | No | Yes | Yes |
| methyl n-amyl ketone | No | Yes | Yes |
| methyl heptine carbonate | Yes | Yes | Yes |
| methyl heptyl ketone | No | — | Yes |
| dimethyl octanol | No | — | Yes |
| hexyl tiglate | No | — | Yes |
| undecylenic aldehyde | Yes | — | Yes |
| citral | No | — | Yes |
| citronellyl acetate | No | — | Yes |
| undecalactone gamma | Yes | — | Yes |
| geranyl formate | — | | Yes |
| hydroxycitronellal | No | | Yes |
| phenyl ethyl alcohol | No | Yes | Yes |
| benzyl alcohol | No | Yes | Yes |
| methyl nonyl acetaldehyde | No | — | Yes |
| citronellol | No | — | Yes |
| benzyl formate | — | — | Yes |
| dihydro myrcenol | No | Yes | Yes |
| heliotropin | Yes | Yes | Yes |
| methyl octyl acetaldehyde | No | — | Yes |
| linalool | Yes | Yes | Yes |
| tetra hydro linalool | No | Yes | Yes |
| jasmone, cis | No | — | Yes |
| methyl dihydro jasmonate | No | — | Yes |
| phenoxy ethanol | No | Yes | Yes |
| dodecalactone gamma | Yes | — | Yes |
| cyclal c | Yes | — | Yes |
| ligustral | — | Yes | Yes |
| benzyl propionate | — | — | Yes |
| phenyl acetaldehyde dimethyl acetal | No | — | — |
| cinnamyl formate | — | — | Yes |
| geranlol | No | Yes | Yes |
| phenoxy ethyl propionate | — | — | Yes |
| methyl benzoate | — | Yes | Yes |
| anisic aldehyde, para | Yes | Yes | Yes |
| allyl cyclohexane propionate | No | — | Yes |
| geranyl acetate | No | — | Yes |
| phenyl ethyl acetate | No | — | Yes |
| cis-3-hexenyl salicylate | Yes | — | Yes |
| helional | No | Yes | Yes |
| para methyl acetophenone | No | — | Yes |
| cinnamic aldehyde | — | Yes | Yes |
| dimethyl anthranilate | No | Yes | Yes |
| vanillin | Yes | — | Yes |
| amyl salicylate | No | — | Yes |
| benzyl acetate | No | Yes | Yes |
| benzaldehyde | No | Yes | Yes |
| para hydroxy phenyl butanone | Yes | — | — |
| abierate cn | No | Yes | Yes |
| phenoxy ethyl iso butyrate | — | — | Yes |
| cymal | Yes | Yes | Yes |
| carvone laevo | — | Yes | Yes |
| linalyl acetate | No | Yes | Yes |
| ethyl vanillin | Yes | Yes | Yes |
| benzyl acetone | Yes | — | Yes |
| hexyl cinnamic aldehyde | No | — | Yes |
| methyl phenyl carbinyl acetate | No | — | Yes |
| coumarin | Yes | — | Yes |
| amyl cinnamic aldehyde | No | — | Yes |
| ionone alpha | Yes | — | Yes |
| hexyl salicylate (n-) | No | — | Yes |
| ethyl methyl phenyl glycidate | Yes | Yes | Yes |
| p.t. bucinal | Yes | — | Yes |
| eucalyptol | No | Yes | Yes |
| patchon | No | — | — |
| methyl cyclo geraniate | — | — | — |
| methyl eugenol | No | — | — |
| alpha terpineol | — | Yes | Yes |
| eugenol | Yes | Yes | Yes |
| phenyl ethyl phenyl acetate | No | — | Yes |

-continued

| Agents | ODT ≦ 10 ppb | BP < 300° C. | ClogP > 1.0 |
|---|---|---|---|
| methyl anthranilate | Yes | Yes | Yes |
| terpineol | — | — | Yes |
| ionone-ab | — | — | Yes |
| triethyl citrate | — | Yes | Yes |
| iso eugenol | Yes | — | Yes |
| verdol | No | — | — |
| diethyl phthalate | — | Yes | Yes |
| phenyl ethyl benzoate | No | — | — |
| benzyl benzoate | — | Yes | Yes |
| ionone gamma methyl | — | — | Yes |
| lyral | Yes | — | Yes |
| 3,5,5-trimethyl hexanal | No | — | — |
| allyl amyl glycolate | Yes | — | — |
| bacdanol | Yes | — | — |
| butyl anthranilate | Yes | — | — |
| calone 1951 | Yes | — | — |
| cinnamic alcohol | Yes | Yes | Yes |
| corps 4322 | No | — | — |
| cyclogalbanate 3/024061 | Yes | — | — |
| cyctohexyl anthranilate | No | — | — |
| cyclopidene | No | — | — |
| damascenone | Yes | — | Yes |
| damascone alpha | No | — | Yes |
| decyl aldehyde | No | Yes | Yes |
| dihydro iso jasmonate | Yes | — | Yes |
| dihydroambrate | No | — | — |
| dimethyl benzyl carbinol | No | — | Yes |
| dimyrcetol | No | — | — |
| dulcinyl | No | — | — |
| ebanol | No | — | — |
| ethyl-2-methyl butyrate | Yes | — | Yes |
| floralol | No | — | — |
| florhydral | No | — | — |
| freskomenthe/2-sec-butyl cyclohexanone | No | — | — |
| hawthanol | No | — | — |
| hydratropic aldehyde | No | — | Yes |
| ionone beta | Yes | — | Yes |
| iso cyclo citral | Yes | — | — |
| iso cyclo geraniol | No | — | — |
| iso hexenyl cyclohexenyl carboxaldehyde/myrac aldehyde | No | — | Yes |
| iso nonyl acetate | — | — | Yes |
| isopentyrate | No | — | — |
| lauric aldehyde | No | — | Yes |
| livescone | No | — | — |
| mandarin aldehyde/dodecenal 3- | No | — | — |
| methyl nonyl ketone | Yes | — | Yes |
| methyl salicylate | No | Yes | Yes |
| nectaryl | No | — | — |
| nerol | Yes | — | Yes |
| orivone | No | — | — |
| phenyl acetaldehyde | Yes | Yes | Yes |
| phenyl hexanol | No | — | Yes |
| phenyl propyl alcohol | No | — | — |
| rosalva | No | — | Yes |
| sandalore | No | — | Yes |
| tetra hydro myrcenol | No | — | Yes |
| thymol | No | Yes | Yes |
| trimenal/2,5,9-trimethyl dodecadienal | No | — | — |
| triplal | No | — | Yes |
| undec-2-en-1-al | No | — | Yes |
| undecavertol | No | — | — |

Preferred perfume materials according to the present invention include the perfume aldehydes such as methyl nonyl acetaldehyde, PT bucinal, decyl aldehyde and anisic aldehyde; the perfume ketones such as p-methoxy acetophenone, para-methyl acetophenone, damascenone, methyl hexyl ketone; perfume amines such as methyl anthranilate, cyclohexyl anthranilate; perfume alcohols such as linalool, dihydromyrcenol, phenylethyl alcohol and undecavertol; and perfume esters such as me-dihydrojasmonate, allylcyclohexane propionate, para cresyl isobutyrate and benzyl acetate. Of course, when mixtures of perfume materials are employed and loaded into the zeolite material, it is the perfume or perfumes with reactive functional groups which are referred to as the deliverable agent.

Size Enlarging Agent

The size enlarging agent as employed in the present invention is any agent which can be incorporated into the zeolite material and act in conjunction with the deliverable agent to form the release inhibitor. The size enlarging agent must satisfy the selection criteria as detailed above for the inclusion of agents into the zeolite. That is, the size enlarging agent must be a "deliverable agent" as described above.

Preferably, the size enlarging agent is also a perfume material. By designing the size enlarging agent as a perfume material, the amount of perfume material incorporated into the limited volume zeolite material can be maximized. Should the size enlarging agent be a non-perfume material, the compound should preferably also be non-odorous and non-toxic. For example, most non-perfume amine compounds that are small enough to fit into the zeolite pores have a distinct amine or "fishy" odor. Suitable examples of non-perfume amine compounds suitable for use in the present invention include 3,4 methylenedioxyaniline, 2-aminobenzyl alcohol, methyl 4-arninobenzoate and 2-amino-diphenyl methane.

The identity of the size enlarging agent will vary depending upon the deliverable agent selected. In those instances where the deliverable agent includes either an aldehyde or ketone functionality, the size enlarging agent can include an amine functionality. On the other hand, in cases where the deliverable agent includes an amine functionality the size enlarging agent can include either an aldehyde or a ketone functionality. Also by way of example, when the deliverable agent includes an aldehyde or ketone functionality, the size enlarging agent can be a perfume or non-perfume with an alcohol functionality. When the deliverable agent includes an alcohol functionality, the size enlarging agent can include an aldehyde or a ketone functionality. Lastly, when the deliverable agent includes an ester functionality, the size enlarging agent may include a perfune or non-perfume alcohol or an ester functionality.

Porous Carrier

The porous carrier as described herein is a porous zeolite having a multitude of pore openings. The term "zeolite" used herein refers to a crystalline aluminosilicate material. The structural formula of a zeolite is based on the crystal unit cell, the smallest unit of structure represented by $$Mm/n[(A102)m(SiO2)y].xH20$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

The zeolite useful herein is a faujasite-type zeolite, including Type X Zeolite or Type Y Zeolite, both with a nominal pore size of about 8 Angstrom units, typically in the range of from about 7.4 to about 10 Angstrom units. The zeolites useful in the present invention have a number of larger size pore openings and smaller size pore openings. The larger size pore openings are of sufficient size such that deliverable agents as described above can pass through the opening. The smaller pore openings of the zeolite while being too small to allow deliverable agents through the pore, are of sufficient size to allow water into the openings. While not wishing to be bound by theory, it is believed that through the distribution of smaller pore openings, water gains access to the release inhibitor allowing hydrolysis to occur and release of the deliverable agent. The larger distribution of zeolite pore openings through which the deliverable agents gain access to the zeolite generally has a cross-sectional size of at least about 35 square angstroms and more preferably greater than about 40 square angstroms.

The aluminosilicate zeolite materials useful in the practice of this invention are commercially available. Methods for producing X and Y-type zeolites are well- known and available in standard texts. Preferred synthetic crystalline aluminosilicate materials useful herein are available under the designation Type X or Type Y.

For purposes of illustration and not by way of limitation, in a preferred embodiment, the crystalline aluminosilicate material is Type X and is selected from the following:

$$Na_{86}[A10_2]_{86}.(SiO_2)_{106}].xH_2O, \quad (I)$$

$$K_{86}[A10_2]_{86}.(SiO_2)_{106}].xH_2O, \quad (II)$$

$$Ca_{40}Na_6[A10_2]_{86}.(SiO_2)_{106}].xH_2O, \quad (III)$$

$$Sr_{21}Ba_{22}[A10_2]_{86}.(SiO_2)_{106}].xH_2O, \quad (IV)$$

and mixtures thereof, wherein x is from about 0 to about 276. Zeolites of Formula (I) and (II) have a nominal pore size or opening of 8.4 Angstroms units. Zeolites of Formula (III) and (IV) have a nominal pore size or opening of 8.0 Angstroms units.

In another preferred embodiment, the crystalline aluminosilicate material is Type Y and is selected from the following:

$$Na_{56}[A10_2]_{56}.(SiO_2)_{136}].xH2O, \quad (V)$$

$$K_{56}[A10_2]_{56}.(SiO_2)_{136}].xH2O \quad (VI)$$

and mixture thereof, wherein x is from about 0 to about 276. Zeolites of Formula (V) and (VI) have a nominal pore size or opening of 8.0 Angstroms units.

Zeolites used in the present invention are in particle form having an average particle size from about 0.5 microns to about 120 microns, preferably from about 0.5 microns to about 30 microns, as measured by standard particle size analysis technique.

The size of the zeolite particles allows them to be entrained in the fabrics with which they come in contact. Once established on the fabric surface (with their coating matrix having been totally or partially washed away during the laundry process), the zeolites can begin to release their incorporated laundry agents, especially when subjected to moisture.

Incorporation of Perfume in Zeolite - The Type X or Type Y Zeolites to be used herein preferably contain less than about 10% desorbable water, more preferably less than about 8% desorbable water, and most preferably less than about 5% desorbable water. Such materials may be obtained by first activating/dehydrating by heating to about 150–350° C., optionally with reduced pressure (from about 0.001 to about 20 Torr), for at least 12 hours. After activation, either the deliverable agent or the size enlarging agent is slowly and thoroughly mixed with the activated zeolite. Next, the second of the agents is slowly and thoroughly mixed with the activated zeolite, and optionally heated to about 60° C. for up to about 2 hours to accelerate absorption equilibrium within the zeolite particles. The order of addition of the two agents is not critical. However, it is preferred that the two agents be added individually. Mixture of the two agents before incorporation into the zeolite may lead to premature formation of the release inhibitor and prevent incorporation into the zeolite.

After being loaded, the zeolite material is preferably heated to a temperature of from 50° C. to about 250° C., more preferably from about 125° C. to about 175° C. for up to about 2 hours to accelerate formation of the release inhibitor. However, heating may not be required depending upon the materials employed. The perfume/zeolite mixture is then cooled to room temperature and is in the form of a free-flowing powder.

If required, an acid catalyst may also be employed in the present invention to facilitate formation of the release inhibitor. The acid employed is preferably an organic acid such as citric, tartaric, lactic, malic, etc. Mineral acids are not generally preferred as they can be to strongly acidic and damage the porous carrier. The catalyst may be employed at typical catalytic levels which may vary depending upon the particular ingredients and the levels of the ingredients.

The total zeolite payload comprises the maximum amount of materials which may be incorporated into the zeolite carrier. A zeolite carrier having the materials incorporated into the zeolite is referred to as a loaded particle. The zeolite payload is less than about 20%, typically less than about 18.5%, by weight of the loaded particle, given the limits on the pore volume of the zeolite. It is to be recognized, however, that the present invention particles may have agents in an amount which will exceed the payload level, but recognizing that excess levels will not be incorporated into the zeolite. Therefore, the present invention particles may comprise more than 20% by weight of agent in the present invention particles. Since any excess laundry agents (as well as any non-deliverable agents present) are not incorporated into the zeolite pores, these materials are likely to be immediately released to the wash solution upon contact with the aqueous wash medium.

The deliverable agent and the size enlarging agent are preferably employed in a ratio of deliverable agent to size enlarging agent of from about 25:1 to about 1:25 and more preferably from about 1.25:1 to about 1:1. Of course. the deliverable agent and size enlarging agent may only be two of a number of compounds loaded into the zeolite.

Coating Matrix

The laundry particles of the present invention may further comprise a coating matrix as described in WO 94/28107, published Dec. 8, 1994. The matrix employed in the delivery system of this invention therefore preferably comprises a fluid diol or polyol, such as glycerol, ethylene glycol, or diglycerol (suitable fluid diols and polyols typically have a M.P. below about −10° C.) and, optionally but preferably, a solid polyol containing more than three hydroxyl moieties, such as glucose, sorbitol, and other sugars. The solid polyol should be dissolvable with heating in the fluid diol or polyol to form a viscous (approximately 4000 cPs), fluid matrix (i.e., the consistency of honey). The matrix, which is insoluble with the perfume, is thoroughly mixed with the loaded zeolite and, thereby, entraps and "protects" the perfume in the zeolite. The coating matrix helps reduce release of perfume from the zeolite in addition to the release inhibitor. Solubility of the matrix in water enables the loaded zeolite to be released in the aqueous bath during laundering.

The preferred properties of the matrix formed by the fluid diol or polyol and the solid polyol include strong hydrogen-bonding which enables the matrix to attach to the zeolite at the siloxide sites and to compete with water for access to the zeolite; incompatibility of the matrix with the perfume which enables the matrix to contain the perfume molecules inside the zeolite cage and to inhibit diffusion of the perfume out through the matrix during dry storage; hydrophilicity of the matrix to enable the matrix materials to dissolve in water for subsequent perfume release from the zeolites; and humectancy which enables the matrix to serve as a limited water sink to further protect the perfumed zeolite from humidity during storage.

The matrix material comprises from about 20% to about 100%, preferably from about 50% to about 70%, by weight of the fluid diol or polyol and from 0% to about 80%, preferably from about 30% to about 50%, by weight, of one or more solid polyols. Of course, the proportions can vary, depending on the particular solid polyols and fluid polyols that are chosen. The perfume delivery system comprises from about 10% to about 90%, preferably from about 20% to about 40%, by weight of the diol/polyol matrix material.

The present invention may also utilize a glassy particle delivery system comprising the zeolite particle of the present invention. The glass is derived from one or more at least partially water-soluble hydroxylic compounds, wherein at least one of said hydroxylic compounds has an anhydrous, nonplasticized, glass transition temperature, Tg, of about 0° C. or higher. Further the glassy particle has a hygroscpicity value of less than about 80%.

The at least partially water soluble hydroxylic compounds useful herein are preferably selected from the following classes of materials.

1. Carbohydrates, which can be any or mixture of: i) Simple sugars (or monosaccharides); ii) Oligosaccharides (defined as carbohydrate chains consisting of 2–10 monosaccharide molecules); iii) Polysacharides (defined as carbohydrate chains consisting of at least 35 monosaccharide molecules); and iv) Starches.

Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds.

2. All natural or synthetic gums such as alginate esters, carrageenin, agaragar, pectic acid, and natural gums such as gum arabic, gum tragacanth and gum karaya.
3. Chitin and chitosan.
4. Cellulose and cellulose derivatives. Examples include: i) Cellulose acetate and Cellulose acetate phthalate (CAP); ii) Hydroxypropyl Methyl Cellulose (HPMC); iii) Carboxymethylcellulose (CMC); iv) all enteric/aquateric coatings and mixtures thereof.
5. Silicates, Phospates and Borates.
6. Polyvinyl alcohol (PVA).
7. Polyethylene glycol (PEG).

Materials within these classes which are not at least partially water soluble and which have glass transition temperatures, Tg, below the lower limit herein of about 0° C. are useful herein only when mixed in such amounts with the hydroxylic compounds useful herein having the required higher Tg such that the glassy particle produced has the required hygroscopicity value of less than about 80%.

Glass transition temperature. commonly abbreviated "Tg", is a well known and readily determined property for glassy materials. This transition is described as being equivalent to the liquification, upon heating through the Tg region, of a material in the glassy state to one in the liquid state. It is not a phase transition such as melting, vaporization, or sublimation. [See William P. Brennan, "'What is a Tg?' A review of the scanning calorimetry of the glass transition", Thermal Analysis Application Study #7, Perkin-Elmer Corporation, March 1973.] Measurement of Tg is readily obtained by using a Differential Scanning Calorimeter.

For purposes of the present invention, the Tg of the hydroxylic compounds is obtained for the anhydrous compound not containing any plasticizer (which will impact the measured Tg value of the hydroxylic compound). Glass transition temperature is also described in detail in P. Peyser, "Glass Transition Temperatures of Polymers", Polvmer Handbook, Third Edition, J. Brandrup and E. H. Immergut (Wiley-Interscience; 1989), pp. VI/209–VI/277.

At least one of the hydroxylic compounds useful in the present invention glassy particles must have an anhydrous, nonplasticized Tg of at least 0° C., and for particles not having a moisture barrier coating, at least about 20° C., preferably at least about 40° C., more preferably at least 60° C., and most preferably at least about 100° C. It is also preferred that these compounds be low temperature processable, preferably within the range of from about 50° C. to about 200° C, and more preferably within the range of from about 60° C. to about 160° C. Preferred such hydroxylic compounds include sucrose, glucose, lactose, and maltodextrin.

The "hygroscopicity value", as used herein, means the level of moisture uptake by the glassy particles, as measured by the percent increase in weight of the particles under the following test method. The hygroscopicity value required for the present invention glassy particles is determined by placing 2 grams of particles (approximately 500 micron size particles; not having any moisture barrier coating) in an open container petrie dish under conditions of 90° F. and 80% relative humidity for a period of 4 weeks. The percent increase in weight of the particles at the end of this time is the particles hygroscopicity value as used herein. Preferred particles have hygroscopicity value of less than about 50%, more preferably less than about 10%.

The glassy particles useful in the present invention typically comprise from about 10% to about 99.99% of at least partially water soluble hydroxylic compounds, preferably from about 20% to about 90%, and more perferably from about 20% to about 75%. The glassy particles of the present invention also typically comprise from about 0.01% to about 90% of the present invention particles preferably from about 10% to about 80%, and more perferably from about 25% to about 80%.

Methods for making these glassy particles are extrapolated from the candy-making art. Such methods include, for example, the methods described in U.S. Pat. No. 2.809,895, issued Oct. 15, 1957 to Swisher.

In addition to its function of containing/protecting the perfume in the zeolite particles, the matrix material also conveniently serves to agglomerate multiple loaded zeolite particles into agglomerates having an overall aggregate size in the range of 200 to 1000 microns, preferably 400 to 600 microns. This reduces dustiness. Moreover, it lessens the tendency of the smaller, individual loaded zeolites to sift to the bottom of containers filled with granular detergents, which, themselves, typically have particle sizes in the range of 200 to 1000 microns.

Optional Detersive Adjuncts

The particles of the present invention may be employed in a number of various compositions including laundry detergents, powdered hard surface cleaners, dry bleaches and cat litter. However, in a preferred embodiment the particles of the present invention are laundry particles and are employed in a laundry detergent. As a preferred embodiment, conventional laundry ingredients may be admixed with the laundry particle of the present invention to provide a detergent composition. The detergent compositions may comprise from about 0.001 % to about 50% by weight of the composition of the particles of the present invention. More typically, the compositions comprise from about 0.01% to about 10% by weight of the particles.

The conventional detergent ingredients employed herein can be selected from typical detergent composition components such as detersive surfactants and detersive builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al. Such adjuncts which can be included in detergent compositions employed in the present invention, in their conventional art-established levels for use (generally from 0% to about 80% of the detergent ingredients, preferably from about 0.5% to about 20%), include color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzymes, enzyme stabilizing agents, solvents. solubilizing agents. chelating agents, clay soil removal/anti-redeposition agents. polymeric dispersing agents. processing aids, fabric softening components, static control agents, bleaching agents, bleaching activators, bleach stabilizers, additional perfume ingredients, etc.

Detersive Surfactant - Detersive surfactants included in the fully-formulated detergent compositions afforded by the present invention comprises at least 1%, preferably from about 1% to about 99.8%, by weight of detergent composition depending upon the particular surfactants used and the effects desired. In a highly preferred embodiment, the detersive surfactant comprises from about 5% to about 80% by weight of the composition.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonlimiting examples of surfactants useful herein include the conventional $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

One class of nonionic surfactant particularly useful in detergent compositions of the present invention is condensates of ethylene oxide with a hydrophobic moiety to provide a surfactant having an average hydrophilic-lipophilic balance (HLB) in the range of from 5 to 17, preferably from 6 to 14, more preferably from 7 to 12. The hydrophobic (lipophilic) moiety may be aliphatic or aromatic in nature. The length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol, the $C_{12}$–$C_{15}$ primary alcohols containing 3–5 moles of ethylene oxide per mole of alcohol, and mixtures thereof.

Another suitable class of nonionic surfactants comprises the polyhydroxy fatty acid amides of the formula:

$$R^2C(O)N(R^1)Z \qquad \text{(I)}$$

wherein: $R^1$ is H, $C_1$–$C_8$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{32}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceralde-hyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_{20}H)—(CHOH)_{n-1_1}—CH_2OH$, $—CH_2—(CHOH)_2(CHOR')(CHOH)—CH_2OH$, where n is an integer from 1 to 5, inclusive, and R' is H or a cyclic mono- or polysaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl. For highest sudsing, $R^1$ is preferably methyl or hydroxyalkyl. If lower sudsing is desired, $R^1$ is preferably $C_2$–$C_8$ alkyl, especially n-propyl, iso-propyl, n-butyl, iso-butyl, pentyl, hexyl and 2-ethyl hexyl.

$R^2—CO—N<$ can be, for example, cocamide, stearamide, oleamide, lauramide, myristamide, capricamide, palmitamide, tallowarnide, etc. (It is to be understood that separate portions of the polyhydroxy fatty acid amides can be used both as the detersive surfactant in the detergent compositions herein, and as the solid polyol of the matrix material used to coat the preferred zeolites.)

Enzymes

Enzymes can be included in the formulations herein for a wide variety of fabric laundering or other cleaning purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc.. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh et al, "Bleaching Compositions Comprising Protease Enzymes" having U.S. Ser. No. 08/322,677. both filed Oct. 13, 1994, and also in WO 95/10615, published Apr. 20, 1995.

Amylases suitable herein include, for example, α-amylases described in British Patent Specification No. 1,296,839 (Novo), RAPIDASE®, International Bio-Synthetics, Inc. and TERMAMYL®, Novo Industries.

Engineering of enzymes (e.g., stability-enhanced amylase) for improved stability, e.g., oxidative stability is known. See, for example J. Biological Chem., Vol. 260, No. 11, June 1985, pp 6518–6521. "Reference amylase" refers to a conventional amylase inside the scope of the amylase component of this invention. Further, stability-enhanced amylases, also within the invention, are typically compared to these "reference amylases".

The present invention, in certain preferred embodiments, can makes use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the ADD (Automatic Dishwashing Detergent) compositions of the invention. Even more preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-arnylase. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the preferred embodiments of the invention can be obtained from Novo Nordisk A/S, or from Genencor International.

Preferred amylases herein have the commonality of being derived using site-directed mutagenesis from one or more of the Baccillus amylases, especialy the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B.subtilis,* or *B. stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S. These amylases include those commercially marketed as DURAMYL by NOVO; bleach-stable amylases are also commercially available from Genencor.

Any other oxidative stability-enhanced amylase can be used, for example as derived by site-directed mutagenesis from known chimeric, hybrid or simple mutant parent forms of available amylases.

Cellulases usable in, but not preferred, for the present invention include both bacterial or fungal cellulases. Typically, they will have a pH optimum of between 5 and 9.5. Suitable cellulases are disclosed in U.S. Pat. No. 4,435,307. Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE® enzyme derived from Humicola lanuginosa and commercially available from Novo (see also EPO 341,947) is a preferred lipase for use herein. Another preferred lipase enzyme is the D96L variant of the native Humicola lanuginosa lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457. Place et al, issued Jul. 18, 1978. and in U.S. Pat. No. 4,507,219. Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Bleaching Compounds - Bleaching Agents and Bleach Activators

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application 740,446, Bums et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1.000 micrometers, not more than about 10% by weight of said particles being smaller than about 200 micrometers and not more than about 10% by weight of said particles being larger than about 1.250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanarnido-caproyl) oxybenzenesulfonate, (6-nonanamidocaproyl) oxybenzenesul-fonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

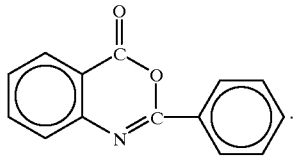

Still another class of preferred bleach activators includes the acyl lactam activators, especially acyl caprolactams and acyl valerolactams of the formulae:

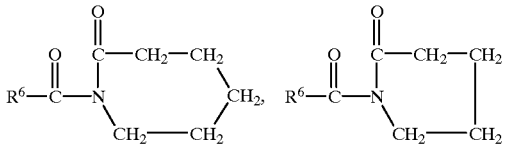

wherein $R^6$ is H or an alkyl, aryl, alkoxyaryl, or alkaryl group containing from 1 to about 12 carbon atoms. Highly preferred lactarn activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a bleach catalyst compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn_{IV}{}^2(u\text{-}O)_3(1,4,7\text{-trimethyl- }1,4,7\text{-triazacyclo-nonane})_2(PF_6)_2$, $Mn^{III}{}_2(u\text{-}O)_1(u\text{-}OAc)_2(1,4,7\text{-trimethyl- }1,4,7\text{-triazacyclononane})_2\text{-}(ClO_4)_2$, $Mn^{IV}{}_4(u\text{-}O)_6(1,4,7\text{-triazacyclononane})_4(ClO_4)_4$, $Mn^{III}Mn^{IV}{}_4(u\text{-}O)_1(u\text{-}OAc)_2\text{-}(1,4,7\text{-trimethyl- }1,4,7\text{-triazacyclononane})_2(ClO_4)_3$, $Mn^{IV}(1,4,7\text{-trimethyl-}1,4,7\text{-triazacyclononane})\text{- }(OCH_3)_3(PF_6)$, and mixtures thereof. Other metal-based bleach catalysts include those disclosed in U.S. Pat. No. 4,430,243 and U.S. Pat. No. 5.114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

Preferred are cobalt (III) catalysts having the formula:

$$Co[(NH_3)^n\ M'_mB'_bT'_tQ_qP_p]\ Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b +3t +4q +5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred catlysts for the present invention include cobalt catalysts of the formula:

$$[CO(NH_3)_n(M')_m]\ Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]\ Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]\ T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counter-anions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2,}$ $NCS^-$, $SCN^-$, $S_2O_3^{-2}$, $NH_3^-$, $PO_4^{3}$-, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, HOC(O)$CH_2$C(O)O—, etc.) Preferred M moieties are substituted and unsubstituted $C_1$–$C_{30}$ carboxylic acids having the formulas:

RC(O)O— wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4{}^+$, —C(O)OR', —OR', —C(O)$NR'_2$, wherein R' is selected from the group consisting of hydrogen and $C_1$–$C_6$ moieties. Such substituted R therefore include the moieties —$(CH_2)_n$OH and —$(CH_2)_n NR'_4{}^+$, wherein n is an integer from 1to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid. and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", Adv. Inorg. Bioinorg. Mech., (1983), 2, pages 1–94. For example, Table 1 at page 17, provides the base hydrolysis rates (designated therein as $k_{OH}$) for cobalt pentaanine catalysts complexed with oxalate ($k_{OH}$=2.5×$10^{-4}$ $M^{-1}$ $s^{-1}$(25° C.)), $NCS^-$($k_{OH}$=5.0×$10^{-4}$ $M^{-1}$ $s^{-1}$ (25° C.)), formate ($k_{OH}$=5.8×$10^{-4}$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]$ $T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co\text{-}(NH_3)_5OAc](BF_4)_2$; and $[(Co(NH_3)_5OAc](NO_3)_2$ (herein "PAC").

These cobalt catalysts are readily prepared by known procedures, such as taught for example in the Tobe article hereinbefore and the references cited therein, in U.S. Pat. No. 4,810,410, to Diakun et al, issued Mar. 7, 1989, J. Chem. Ed. (1989), 66 (12), 1043–45; The Synthesis and Characterization of Inorganic Compounds, W. L. Jolly (Prentice-Hall; 1970), pp. 461–3; Inorg. Chem., 18, 1497–1502 (1979); Inorg. Chem., 21, 2881–2885 (1982); Inorg. Chem., 18, 2023–2025 (1979); lnorg. Synthesis, 173–176 (1960); and Journal of Physical Chemistry, 56, 22–25 (1952); as well as the synthesis examples provided hereinafter.

These catalysts may be coprocessed with adjunct materials so as to reduce the color impact if desired for the aesthetics of the product, or to be included in enzyme-containing particles as exemplified hereinafter, or the compositions may be manufactured to contain catalyst "speckles".

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%. by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolarnrnonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called ›weak? builders (as compared with phosphates) such as citrate, or in the so-called ›underbuilt? situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071. issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4.102,903.

Other useful detergency builders include the ether hydroxypolyvcarboxylates, copolymers of maleic anhydride with ethylene or vinyl methyl ether, 1, 3, 5-trihydroxy benzene-2, 4, 6-trisulphonic acid. and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example. U.S. Pat. Nos. 3,159,.581; 3,213,030; 3,422.021; 3,400,148 and 3,422,137) can also be used.

Polymeric Soil Release Agent

Known polymeric soil release agents, hereinafter "SRA", can optionally be employed in the present detergent compositions. If utilized, SRA's will generally comprise from 0.01% to 10.0%. typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

SRA's can include a variety of charged, e.g., anionic or even cationic species, see U.S. Pat. No. 4,956,447, issued Sep. 11, 1990 to Gosselink, et al., as well as noncharged monomer units, and their structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT PG and poly(ethyleneglycol) ("PEG"). Other examples of SRA's include: the partly- and fully- anionic-end-capped oligomeric esters of U.S. Pat. No. 4,721,580, Jan. 26. 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Suitable SRA's characterised by poly(vinyl ester) hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN SRA's such as SOKALAN HP-22, available from BASF, Germany. Other SRA's are polyesters with repeat units containing 10–15% by weight of ethylene terephthalate together with 80–90% by weight of polyoxyethylene terephthalate derived from a polyoxyethylene glycol of average molecular weight 300–5,000. Commercial examples include ZELCON 5126 from Dupont and MILEASE T from ICI.

Another preferred SRA is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two end-cap units derived from sodium 2-(2-hydroxyethoxy)-ethanesulfonate. Said SRA preferably further comprises from 0.5% to 20%, by weight of the oligomer, of a crystallinity-reducing stabiliser, for example an anionic surfactant such as linear sodium dodecylbenzenesulfonate or a member selected from xylene-, cumene-, and toluene- sulfonates or mixtures thereof, these stabilizers or modifiers being introduced into the synthesis vessel, all as taught in U.S. Pat. No. 5,415,807, Gosselink, Pan, Kellett and Hall, issued May 16, 1995. Suitable monomers for the above SRA include Na-2-(2-hydroxyethoxy)-ethanesulfonate, DMT, Na-dimethyl-5-sulfoisophthalate, EG and PG.

Yet another group of preferred SRA's are oligomeric esters comprising: (1) a backbone comprising (a) at least one unit selected from the group consisting of dihydroxysulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred are esters of the empirical formula:

$$\{(CAP)x(EG/PG)y'(DEG)y''(PEG)y'''(T)z(SIP)z'(SEG)q(B)m\}$$

wherein CAP, EG/PG, PEG, T and SIP are as defined hereinabove, (DEG) represents di(oxyethylene)oxy units, (SEG) represents units derived from the sulfoethyl ether of glycerin and related moiety units, (B) represents branching units which are at least trifunctional whereby ester linkages are formed resulting in a branched oligomer backbone, x is from about I to about 12, y' is from about 0.5 to about 25, y" is from 0 to about 12, y'" is from 0 to about 10, y'+y"+y'" totals from about 0.5 to about 25, z is from about 1.5 to about 25, z' is from 0 to about 12; z+z' totals from about 1.5 to about 25, q is from about 0.05 to about 12; m is from about 0.01 to about 10, and x, y', y", y'", z, z', q and m represent the average number of moles of the corresponding units per mole of said ester and said ester has a molecular weight ranging from about 500 to about 5,000.

Preferred SEG and CAP monomers for the above esters include Na-2-(2-,3-dihydroxypropoxy)ethanesulfonate ("SEG"), Na-2-{2-(2-hydroxyethoxy) ethoxy} ethanesulfonate ("SE3") and its homologs and mixtures thereof and the products of ethoxylating and sulfonating allyl alcohol. Preferred SRA esters in this class include the product of transesterifying and oligomerizing sodium 2-{2-(2-hydroxyethoxy)ethoxy}ethanesulfonate and/or sodium 2-[2-{2-(2-hydroxyethoxy)ethoxy}-ethoxy]ethanesulfonate, DMT, sodium 2-(2,3-dihydroxypropoxy) ethane sulfonate, EG, and PG using an appropriate Ti(IV) catalyst and can be designated as (CAP)2(T)5(EG/PG)1.4(SEG)2.5(B)0.13 wherein CAP is ($Na+O_3S[CH_2CH_2O]3.5$)— and B is a unit from glycerin and the mole ratio EG/PG is about 1.7:1 as measured by conventional gas chromatography after complete hydrolysis.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al.. Other classes include: (III) anionic terephthalate-based SRA's of the urethane-linked variety, see U.S. Pat. No. 4,201,824, Violland et al.; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; (V) graft copolymers, in addition to the SOKALAN types from BASF, made by grafting acrylic monomers onto sulfonated polyesters. These SRA's assertedly have soil release and anti-redeposition activity similar to known cellulose ethers: see EP 279,134 A, 1988, to Rhone-Poulenc Chemie. Still other classes include: (VI) grafts of vinyl monomers such as acrylic acid and vinyl acetate onto proteins such as caseins, see EP 457,205 A to BASF (1991); and (VII) polyester-polyamide SRA's prepared by condensing adipic acid, caprolactarn, and polyethylene glycol, especially for treating polyamide fabrics, see Bevan et al., DE 2,335,044 to Unilever N. V., 1974. Other useful SRA's are described in U.S. Pat. Nos. 4,240,918, 4,787,989 and 4,525,524.

Chelating Agents

The detergent compositions herein may also optionally contain one or more heavy metal chelating agents. Such chelating agents can be selected from the group consisting of amino carboxylates. amino phosphonates, polyfunctionally-substituted aromatic chelating agents and mixtures therein, all as hereinafter defined. Without intending to be bound by theory. it is believed that the benefit of these materials is due in part to their exceptional ability to remove heavy metals such as iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1.2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents

The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27. 1984. Other clay soil removal/antiredeposition agents which can be used include the ethoxylated amine polymers disclosed in European Patent Application 111,984 Gosselink, published Jun. 27. 1984; the zwitterionic polymers disclosed in European Patent Application 112,592, Gosselink, published Jul. 4, 1984; and the amine oxides disclosed in U.S. Pat. No. 4,548,744. Cornor, issued Oct. 22. 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents

Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Brightener

Any optical brighteners or other brightening or whitening agents known in the art can be incorporated at levels typically from about 0.01% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, the 2-(4-styryl-phenyl)-2H-naptho[1,2-d]triazoles; 4,4'-bis-(1,2,3-triazol-2-yl)-stilbenes; 4,4'-bis(styryl) bisphenyls; and the amino-coumarins. Specific examples of these brighteners include 4-methyl-7-diethyl-amino coumarin; 1,2-bis(benzimidazol-2-yl)ethylene; 1,3-diphenyl-pyrazolines; 2,5-bis(benzoxazol-2-yl)thiophene; 2-styryl-naptho[1,2-d]oxazole; and 2-(stilben-4-yl)-2H-naphtho[1,2-d]triazole. See also U.S. Pat. No. 3,646,015, issued Feb. 29, 1972 to Hamilton.

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point farther, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoarn agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide. like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Fabric Softeners

Various through-the-wash fabric softeners, especially the impalpable smectite clays of U.S. Pat. No. 4,062,647, Storm and Nirschl, issued Dec. 13, 1977. as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416. Crisp et al, Mar. 1, 1983 and U.S. Pat. No. 4,291.071, Harris et al, issued Sep. 22, 1981.

Other Ingredients

A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.5 and 10.5. Liquid dishwashing product formulations preferably have a pH between about 6.8 and about 9.0. Laundry products are typically at pH 9–11. Techniques for controlling pH at recomrnmended usage levels include the use of buffers, alkalis, acids, etc., and are well known to those skilled in the art.

Dye Transfer Inhibiting: Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R-$A_x$-P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

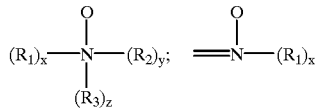

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., Chemical Analysis, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5.000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

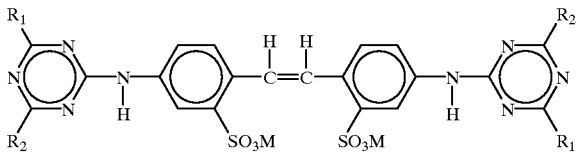

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradenarne Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a pararneter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

High Density Granular Detergent Composition

The granular detergent compositions of the present invention can be used in both low density (below 550 grams/liter) and high density granular forms in which the density of the granule is at least 550 grams/liter. Such high density detergent compositions typically comprise from about 30% to about 90% of detersive surfactant.

Low density compositions can be prepared by standard spray- drying processes. Various means and equipment are available to prepare high density granular detergent compositions. Current commercial practice in the field employs spray-drying towers to manufacture granular laundry detergents which often have a density less than about 500 g/l. Accordingly, if spray drying is used as part of the overall process, the resulting spray-dried detergent particles must be further densified using the means and equipment described hereinafter. In the alternative, the formulator can eliminate spray-drying by using mixing, densifying and granulating equipment that is commercially available. The following is a nonlimiting description of such equipment suitable for use herein.

High speed mixer/densifiers can be used in the present process. For example, the device marketed under the trademark "Lodige CB30" Recycler comprises a static cylindrical mixing drum having a central rotating shaft with mixing/cutting blades mounted thereon. Other such apparatus includes the devices marketed under the trademark "Shugi Granulator" and under the trademark "Drais K-TTP 80". Equipment such as that marketed under the trademark "Lodige KM600 Mixer" can be used for further densification.

In one mode of operation, the compositions are prepared and densified by passage through two mixer and densifier machines operating in sequence. Thus, the desired compositional ingredients can be admixed and passed through a Lodige mixture using residence times of 0.1 to 1.0 minute then passed through a second Lodige mixer using residence times of 1 minute to 5 minutes.

In another mode, an aqueous slurry comprising the desired formulation ingredients is sprayed into a fluidized bed of particulate surfactants. The resulting particles can be further densified by passage through a Lodige apparatus, as noted above. The perfume delivery particles are admixed with the detergent composition in the Lodige apparatus.

The final density of the particles herein can be measured by a variety of simple techniques, which typically involve dispensing a quantity of the granular detergent into a container of known volume, measuring the weight of detergent and reporting the density in grams/liter.

Once the low or high density granular detergent "base" composition is prepared, the agglomerated perfume delivery system of this invention is added thereto by any suitable dry-mixing operation.

Deposition of Perfume onto Fabric Surfaces

The method of washing fabrics and depositing perfiune thereto comprises contacting said fabrics with an aqueous wash liquor comprising at least about 100 ppm of conventional detersive ingredients described hereinabove, as well as at least about 0.1 ppm of the above-disclosed perfume delivery system. Preferably, said aqueous liquor comprises from about 500 ppm to about 20,000 ppm of the conventional detersive ingredients and from about 10 ppm to about 200 ppm of the perfume delivery system.

The perfume delivery system works under all circumstances, but is particularly useful for providing odor benefits on fabrics during storage, drying or ironing. The method comprises contacting fabrics with an aqueous liquor containing at least about 100 ppm of conventional detersive ingredients and at least about 1 ppm of the perfume delivery composition such that the perfumed zeolite particles are entrained on the fabrics, storing line-dried fabrics under ambient conditions with humidity of at least 20%. drying the fabric in a conventional automatic dryer, or applying heat to fabrics which have been line-dried or machine dried at low heat (less than about 50° C.) by conventional ironing means (preferably with steam or pre-wetting).

The following nonlimiting examples illustrate the parameters of and compositions employed within the invention. All percentages, parts and ratios are by weight unless otherwise indicated.

EXAMPLE I

Production of a laundry agent delivery particle according to the present invention is as follows:

A perfume matrix of perfume raw materials is devided into those perfume materials which include aldehydes andlor ketones and all remaining perfume raw materials as follows:

Aldehyde/Ketone Component

| Perfume Raw Material | Functionality | % of Total Perfume |
|---|---|---|
| Damascenone | Ketone | 0.45 |
| para methyl acetophenone | Ketone | 0.68 |
| Neobutanone | Ketone | 1.48 |
| Florhydral aldehyde | Aldehyde | 0.23 |
| Intreleven | Aldehyde | 0.34 |
| Methy nonyl acetaldehyde | Aldehyde | 0.57 |
| Helional | Aldebyde | 0.68 |

-continued

| Perfume Raw Material | Functionality | % of Total Perfume |
|---|---|---|
| Cyclal C | Aldehyde | 1.48 |
| Anisic aldehyde | Aldehyde | 3.30 |
| Lyral | Aldehyde | 7.16 |
| PT Bucinal | Aldehyde | 22.73 |

Remaining Perfume Ingredients Component

| Perfume Raw Material | Functionality | % of Total Perfume |
|---|---|---|
| Nerol Oxide | Ether | 2.61 |
| Isobornyl Acetate | Ester | 3.00 |
| Citronellol | Alcohol | 4.62 |
| Benzyl Nitrile | Nitrile | 5.15 |
| Fenchyl Alcohol | Alcohol | 7.66 |
| Cinnamic alcohol | Alcohol | 9.09 |
| Flor Acetate | Ester | 12.44 |
| Phenyl ethyl alcohol | Alcohol | 16.67 |

0.419 grams of methyl anthranilate, a liquid perfume raw material which is an amine, is mixed with 0.662 grams of the remaining perfume ingredients component. The mixture is then added to 8.5 grams of activated (dehydrated) Zeolite 1 3X. The sample is mixed by hand with a spatula for about one minute. 0.419 grams of the aldehyde/ketone component is then added to the activated zeolite 13X. Mixing of the ingredients continues for one minute. The sample is then transferred to a Coffee Bean grinder or lab mill and ground for 2–5 minutes. The ground sample is then placed in a glass jar, blanketed with nitrogen and heated for 5 minutes at 150° C. A free-flowing perfine loaded zeolite powder is obtained.

EXAMPLE II

Production of a laundry agent delivery particle according to the present invention is as follows:

A perfume matrix of perfume raw materials as disclosed in Example I and similarity divided is employed as the perfiune component. 0.419 grams of glycerol and 0.01 grams of citric acid are mixed with 0.662 grams of the remaining ingredients component of Example 1. The mixture is then added to 8.5 grams of activated zeolite 13X. The sample is mixed by hand with a spatula for one minute. 0.419 grams of the aldehyde/ketone component is then added to the activated zeolite 13X. Mixing of the ingredients continues for one minute. The sample is then transferred to a Coffee Bean grinder or lab mill and ground for 2–5 minutes. The ground sample is then placed in a glass jar, blanketed with nitrogen and heated for 5 minutes at 150° C. A free-flowing perfume loaded zeolite powder is obtained.

EXAMPLE III

Several detergent compositions made in accordance with the invention and specifically for top-loading washing machines are exemplified below incorporating the perfume particle prepared in Example I.

| Base Granule | A | B | C |
|---|---|---|---|
| Aluminosilicate | 18.0 | 22.0 | 24.0 |
| Sodium Sulfate | 10.0 | 19.0 | 6.0 |
| Sodium Polyacrylate Polymer | 3.0 | 2.0 | 4.0 |
| PolyethyleneGlycol (MW = 400) | 2.0 | 1.0 | — |
| $C_{12-13}$ Linear Alkylbenzene Sulfonate, Na | 6.0 | 7.0 | 8.0 |
| $C_{14-16}$ Secondary Alkyl Sulfate, Na | 3.0 | 3.0 | — |
| $C_{14-15}$ Alkyl Ethoxylated Sulfate, Na | 3.0 | 9.0 | — |
| Sodium Silicate | 1.0 | 2.0 | 3.0 |
| Brightener 24/47[6] | 0.3 | 0.3 | 0.3 |
| Sodium Carbonate | 7.0 | 26.0 | |
| Carboxymethyl Cellulose | — | — | 1.0 |
| DTPMPA[7] | — | — | 0.5 |
| DTPA[1] | 0.5 | — | — |
| Admixed Agglomerates | | | |
| $C_{14-15}$ Alkyl Sulfate, Na | 5.0 | — | — |
| $C_{12-13}$ Linear Alkylbenzene Sulfonate, Na | 2.0 | — | — |
| Sodium Carbonate | 4.0 | — | — |
| Polyethylene Glycol (MW = 4000) | 1.0 | — | — |
| Admix | | | |
| Sodium Carbonate | — | — | 13.0 |
| $C_{14-15}$ Alkyl Ethoxylate (EO = 7) | 2.0 | 0.5 | 2.0 |
| $C_{12-15}$ Alkyl Ethoxylate (EO = 3) | — | — | 2.0 |
| Perfume Spray-On | 0.3 | 1.0 | 0.3 |
| Perfume Particles[9] | 2.0 | 2.0 | 2.0 |
| Polyvinylpyrrilidone | 0.5 | — | — |
| Polyvinylpyridine N-oxide | 0.5 | — | — |
| Polyvinylpyrrolidone-polyvinylimidazoie | 0.5 | — | — |
| Distearylamine & Cumene Sulfonic Acid | 2.0 | — | — |
| Soil Release Polymer[2] | 0.5 | — | — |
| Lipolase Lipase (100.000 LU/I)[4] | 0.5 | — | 0.5 |
| Termamyl Amylase (60 KNU/g)[4] | 0.3 | — | 0.3 |
| CAREZYME ® Cellulase (1000 CEVU/g)[4] | 0.3 | — | — |
| Protease (40 mg/g)[5] | 0.5 | 0.5 | 0.5 |
| NOBS[3] | 5.0 | — | — |
| TAED[8] | — | — | 3.0 |
| Sodium Percarbonate | 12.0 | — | — |
| Sodium Perborate Monohydrate | — | — | 22.0 |
| Polydimethylsiloxane | 0.3 | — | 3.0 |
| Sodium Sulfate | — | — | 3.0 |
| Miscellaneous (water, etc.) | balance | balance | balance |
| Total | 100 | 100 | 100 |

[1]Diethylene Triamine Pentaacetic Acid
[2]Made according to U.S. Pat. 5,415,807, issued May 16, 1995 to Gosselink et al
[3]Nonanoyloxybenzenesulfonate
[4]Purchased from Novo Nordisk A/S
[5]Purchased from Genencor
[6]Purchased from Ciba-Geigy
[7]Diethylene Triamine Pentamethylene Phosophonic Acid
[8]Tetra Acetyle Ethylene Dramine
[9]From Example I

EXAMPLE IV

The following detergent compositions containing a perfume particle from Example I in accordance with the invention are especially suitable for front loading washing machines. The compositions are made in the manner of Examples III.

| | (% Weight) | |
|---|---|---|
| Base Granule | A | B |
| Aluminosilicate | 15.0 | — |
| Sodium Sulfate | 2.0 | — |
| $C_{12-13}$ Linear Alkylbenzene Sulfonate, Na | 3.0 | — |
| DTPMPA[1] | 0.5 | — |
| Carboxymethylcellulose | 0.5 | — |
| Acrylic Acid/Maleic Acid Co-polymer | 4.0 | — |
| Admixed Agglomerates | | |
| $C_{14-15}$ Alkyl Sulfate, Na | — | 11.0 |
| $C_{12-13}$ Linear Alkylbenzene Sulfonate, Na | 5.0 | — |
| $C_{18-22}$ Alkyl Sulfate, Na | 2.0 | — |
| Sodium Silicate | 4.0 | — |
| Aluminosilicate | 12.0 | 13.0 |
| Carboxymethylcellulose | — | 0.5 |
| Acrylic Acid/Maleic Acid Co-polymer | — | 2.0 |
| Sodium Carbonate | 8.0 | 7.0 |
| Admix | | |
| Perfume Spray-On | 0.3 | 0.5 |
| Perfume Particles[4] | 2.0 | 2.0 |
| $C_{12-15}$ Alkyl Ethoxylate (EO = 7) | 4.0 | 4.0 |
| $C_{12-15}$ Alkyl Ethoxylate (EO = 3) | 2.0 | 2.0 |
| Acrylic Acid/Maleic Acid Co-polymer | — | 3.0 |
| Crystalline Layered Silicate[2] | — | 12.0 |
| Sodium Citrate | 5.0 | 8.0 |
| Sodium Bicarbonate | 5.0 | 5.0 |
| Sodium Carbonate | 6.0 | 15.0 |
| Polyvinylpyrrilidone | 0.5 | 0.5 |
| Alcalase protease[3] (3.0 AU/g) | 0.5 | 1.0 |
| Lipolase Lipase[3] (100,000 LU/l) | 0.5 | 0.5 |
| Termamyl Amylase[3] (60 KNU/g) | 0.5 | 0.5 |
| CAREZYME ® Cellulase[3] (1000 CEVU/g) | 0.5 | 0.5 |
| Sodium Sulfate | 4.0 | 0.0 |
| Miscellaneous (water, etc.) | balance | balance |
| Total | 100.0 | 100.0 |

[1]Diethylene Triamine Pentamethylenephosphonic Acid
[2]SKS 6 commercially available from Hoechst
[3]Purchased from Novo Nordisk A/S
[4]From Example I

EXAMPLE V

The following detergent compositions according to the invention are suitable for low wash volume, top loading washing machines.

| Base Granules | (% Weight) A |
|---|---|
| Aluminosilicate | 7.0 |
| Sodium Sulfate | 3.0 |
| PolyethyleneGlycol (MW = 4000) | 0.5 |
| Acrylic Acid/Maleic Acid Co-polymer | 6.0 |
| Cationic Surfactant[1] | 0.5 |
| $C_{14-16}$ Secondary Alkyl Sulfate, Na | 7.0 |
| $C_{12-13}$ Linear Alkylbenzene Sulfonate, Na | 13.0 |
| $C_{14-15}$ Alkyl Ethoxylated Sulfate, Na | 6.0 |
| Crystalline Layered Silicate[2] | 6.0 |
| Sodium Silicate | 2.0 |
| Oleic Fatty Acid, Na | 1.0 |
| Brightener 497 | 0.3 |
| Sodium Carbonate | 28.0 |
| DTPA[3] | 0.3 |

-continued

| Base Granules | (% Weight) A |
|---|---|
| Admix | |
| $C_{12-15}$ Alkyl Ethoxylate (EO = 7) | 1.0 |
| Perfume Spray-On | 1.0 |
| Perfume Particles[8] | 2.0 |
| Soil Release Polymer[4] | 0.5 |
| Polyvinylpyrrilidone | 0.3 |
| Polyvinylpyridine N-Oxide | 0.1 |
| Polyvinylpyrrilidone-polyvinylimidazole | 0.1 |
| Lipoiase Lipase (100.000 LU/g)[6] | 0.3 |
| Termamyl Amylase (60 KNU/g)[6] | 0.1 |
| CAREZYME ® Cellulase (1000 CEVU/g)[6] | 0.1 |
| Savinase (4.0 KNPU/g)[6] | 1.0 |
| NOBS[5] | 4.0 |
| Sodium Perborate Monohydrate | 5.0 |
| Miscellaneous (water, etc.) | balance |
| Total | 100.0 |

[1]C12–14 Dimethyl Hydroxyethyl Quatemary Ammonium Compound
[2]SKS 6 commercially available from Hoechst
[3]Diethylene Triamine Pentaacetic Acid
[4]Made according to U.S. Pat. 5,415,807 issued May 16, 1995 to Gosselink et al
[5]Nonanoyloxybenzenesulfonate
[6]Purchased from Novo Nordisk A/S
[7]Purchased from Ciba-Geigy
[8]From Example I

EXAMPLE VI

The following detergent compositions according to the invention are suitable for machine and handwashing operations. The base granule is prepared by a conventional spray drying process in which the starting ingredients are formed into a slurry and passed through a spray drying tower having a counter current stream of hot air (200–400C.) resulting in the formation of porous granules. The remaining adjunct detergent ingredients are sprayed on or added dry.

| Base Granule | A | B | C |
|---|---|---|---|
| C12–13 Alkylbenzene Sulfonate, Na | 19.0 | 18.0 | 19.0 |
| Cationic Surfactant[5] | 0.5 | 0.5 | — |
| DTPMPA[6] | 0.3 | — | — |
| DTPA[2] | — | 0.3 | — |
| Sodium Tripolyphosphate | 25.0 | 19.0 | 29.0 |
| Acrylic/Maleic Co-polymer | 1.0 | 0.6 | — |
| Carboxymethylcellulose | 0.3 | 0.2 | 0.3 |
| Brightener 49/15/33[4] | 0.2 | 0.2 | 0.2 |
| Sodium Sulfate | 28.0 | 39.0 | 15.0 |
| Sodium Silicate (2.0R) | 7.5 | — | — |
| Sodium Silicate (1.6R) | — | 7.5 | 6.0 |
| Admix | | | |
| Sodium Carbonate | 5.0 | 6.0 | 20.0 |
| $C_{12-13}$ Alkly Ethoxylate (EO = 7) | 0.4 | — | 1.2 |
| Savinase[3] Protease (4 KNPY/g) | 0.6 | — | 1.0 |
| Termamyl[3] Amylase (60 KNU/g) | 0.4 | — | — |
| Lipolase[3] Lipase (100,000 LU/I) | 0.1 | 0.1 | 0.1 |
| Sav/Ban[3] (6 KNPU/100 KNU/g) | — | 0.3 | — |
| CAREZYME ® [3] Cellulase (1000 CEVU/g) | — | 0.1 | — |
| Soil Release polymer[1] | 0.1 | 0.1 | 0.3 |
| Perfume Spray-On | 0.4 | 0.4 | 0.4 |

-continued

| Base Granule | A | B | C |
|---|---|---|---|
| Perfume Particles[7] | 3.0 | 3.0 | 3.0 |
| Miscellaneous (water, etc.) | balance | balance | balance |
| Total | 100.0 | 100.0 | 100.0 |

[1]Made according to U.S. Pat. 5,415,807 issued May 16, 1995 to Gosselink et al
[2]Diethylene Triamine Pentaacetic Acid
[3]Purchased from Novo Nordisk A/S
[4]Purchased from Ciba-Geigy
[5]C12–14 Dimethyl Hydroxyethyl Quaternary Ammonium Compound
[6]Diethylene Triamine Pentamethylenephosphoric Acid
[7]From Example I

EXAMPLE VII

The following detergent composition according to the invention is in the form of a laundry bar which is particularly suitable for handwashing operations.

| | % Weight |
|---|---|
| Coconut Fatty Alkyl Sulfate | 30.0 |
| Sodium Tripolyphosphate | 5.0 |
| Tetrasodium Pyrophosphate | 5.0 |
| Sodium Carbonate | 20.0 |
| Sodium Sulfate | 5.0 |
| Calcium Carbonate | 5.0 |
| $Na_{1.9}K_{0.1}Ca(CO_3)_2$ | 15.0 |
| Aluminosilicate | 2.0 |
| Coconut Fatty Alcohol | 2.0 |
| Perfume Particle[1] | 2.0 |
| Perfume Spray-On | 1.0 |
| Miscellaneous (water, etc.) | Balance |
| Total | 100.0 |

[1]From Example I.

What is claimed is:

1. A laundry agent delivery particle comprising:

a) a porous carrier selected from the group consisting of zeolite X, zeolite Y, and mixtures thereof, said carrier including a number of pore openings; and b) one or more laundry release inhibitors capable of being incorporated into said porous openings, said release inhibitors formed from;

i) a deliverable agent; and ii) a size enlarging agent, said size enlarging agent is selected from the group consisting of aromatic aminophenols, substituted and unsubstituted aminobenzoic acid, aminobenzoate ester, and mixtures thereof.

2. A particle according to claim 1 wherein said agent is 3,4-methylenedioxyaniline, 2-aminobenzyl alcohol, methyl 4-aminobenzoate, 2-amino-diphenyl methane, and mixtures thereof.

3. A granular detergent composition comprising:

A) from 0.001% to 50% by weight, of a laundry delivery particle, said particle comprising:

a) a porous carrier selected from the group consisting of zeolite X, zeolite Y, and mixtures thereof, said carrier including a number of pore openings; and b) one or more laundry release inhibitors capable of being incorporated into said porous openings, said release inhibitors formed from:

i) a deliverable agent: and ii) a size enlarging agent, said size enlarging agent is selected from the group consisting of aromatic aminophenols, substituted and unsubstittitecl aminobenzoic acid, aminobenzoate ester, and mixtures thereof; and B) from 40% to 99.999% by weight, of laundry ingredients selected from the group consisting of detersive surfactants, builders, bleaching agents, enzymes, soil release polymers. dye transfer inhibitors, and mixtures thereof.

4. A composition according to claim 3 wherein said agent is 3,4-methylenedioxyaniline, 2-aminobenzyl alcohol, methyl 4-aminobenzoate, 2-amino-diphenyl methane, and mixtures thereof.

* * * * *